US008701303B1

(12) United States Patent
Hales et al.

(10) Patent No.: US 8,701,303 B1
(45) Date of Patent: Apr. 22, 2014

(54) PERSONAL SCORING TOOL

(75) Inventors: Eric Hales, Eagle Mountain, UT (US); Markus Long, Eagle Mountain, UT (US)

(73) Assignee: Stampin' Up! Inc., Riverton, UT (US)

( * ) Notice: Subject to any disclaimer, the term of this patent is extended or adjusted under 35 U.S.C. 154(b) by 0 days.

(21) Appl. No.: 13/194,592

(22) Filed: Jul. 29, 2011

(51) Int. Cl.
*B43L 13/00* (2006.01)

(52) U.S. Cl.
USPC ..... 33/566

(58) Field of Classification Search
USPC ..... 33/566, 18.1, 18.2, 18.3, 19.2, 19.3, 33/21.1, 562, 563, 574, 576, 577, 430, 432
See application file for complete search history.

(56) References Cited

U.S. PATENT DOCUMENTS

| | | | | | |
|---|---|---|---|---|---|
| 811,787 | A | | 2/1906 | Monske | |
| 1,153,951 | A | | 9/1915 | Plante | |
| 1,221,213 | A | | 4/1917 | Plante | |
| 2,080,093 | A | * | 5/1937 | Rose | 33/566 |
| 4,122,827 | A | | 10/1978 | Rhodes | |
| 4,205,438 | A | | 6/1980 | Sikorski | |
| 4,443,198 | A | | 4/1984 | Ehsanipour | |
| 4,540,375 | A | * | 9/1985 | Fogarty et al. | 446/146 |
| 4,564,414 | A | * | 1/1986 | Houssian et al. | 33/477 |
| 4,679,328 | A | * | 7/1987 | Saad | 33/447 |
| 4,939,968 | A | | 7/1990 | Stoof | |
| 4,976,647 | A | * | 12/1990 | Axtell | 446/151 |
| 5,337,484 | A | * | 8/1994 | Cardon | 33/41.2 |
| 5,378,222 | A | | 1/1995 | Weber | |
| 5,380,265 | A | | 1/1995 | Giovinazzo et al. | |
| 5,383,503 | A | | 1/1995 | Johnson | |
| 5,386,640 | A | * | 2/1995 | Chen et al. | 33/444 |
| 5,484,373 | A | | 1/1996 | Carbone | |
| 5,733,237 | A | | 3/1998 | Marschke et al. | |
| 5,845,409 | A | | 12/1998 | Kimoto | |
| 5,855,543 | A | | 1/1999 | Carbone | |
| 6,092,294 | A | * | 7/2000 | Mak | 33/18.1 |
| 6,216,354 | B1 | * | 4/2001 | Carbone | 33/565 |
| 6,321,457 | B1 | * | 11/2001 | Lariviere et al. | 33/562 |
| 6,349,639 | B1 | | 2/2002 | Smith et al. | |
| 6,536,126 | B2 | * | 3/2003 | Wilson | 33/477 |
| 6,550,812 | B1 | * | 4/2003 | Castillo et al. | 281/37 |
| 6,612,433 | B2 | | 9/2003 | McKenzie | |

(Continued)

OTHER PUBLICATIONS

Martha Stewart, Scoring Board (online catalog), Nov. 9, 2011; http://ecx.images-amazon.com/images/I/51sQAuffG24l._SS500_.jpg.

*Primary Examiner* — Yaritza Guadalupe-McCall
(74) *Attorney, Agent, or Firm* — Jones Waldo Holbrook & McDonough, PC; Brent T. Winder

(57) ABSTRACT

A scoring tool comprising a base with a first edge and a second edge defining a recess; and one or more marker recesses. There is a pad capable of removably fitting into the defined recess and having one or more scoring guide lines. One or more markers having a locking mechanism capable of coupling with the marker recesses is included as is a pen assembly, capable of being removably coupled to the base and having one or more scoring tips. The scoring tool can include one or more marker guides on the first edge of the base, wherein the marker guide is a notch. The markers can include a protrusion capable of resting in the marker guide thereby securing the marker in place. The marker recess can be a hole in the base. The locking mechanism can be a retractable protrusion capable of coupling with the marker recesses.

12 Claims, 8 Drawing Sheets

(56) References Cited

U.S. PATENT DOCUMENTS

| | | | | |
|---|---|---|---|---|
| 6,695,758 | B2 | 2/2004 | Dostie | |
| 6,872,177 | B1 | 3/2005 | Fullington | |
| 7,137,206 | B2 * | 11/2006 | Lira-Núñez | 33/41.2 |
| 7,219,437 | B2 * | 5/2007 | Dallman | 33/286 |
| 7,287,339 | B2 * | 10/2007 | Robertson | 33/562 |
| 7,464,480 | B2 | 12/2008 | Vetromila | |
| 7,536,803 | B2 * | 5/2009 | Samuels | 33/566 |
| 7,753,833 | B2 | 7/2010 | Crick | |
| RE42,888 | E | 11/2011 | Crick | |
| 8,075,982 | B2 * | 12/2011 | Donahue | 428/195.1 |
| D668,560 | S * | 10/2012 | Hales et al. | D10/46 |
| 2002/0152623 | A1 * | 10/2002 | Chen et al. | 33/430 |
| 2003/0073556 | A1 | 4/2003 | Carbone | |
| 2003/0093910 | A1 * | 5/2003 | Chang | 33/566 |
| 2003/0118689 | A1 | 6/2003 | Carlson et al. | |
| 2006/0096110 | A1 * | 5/2006 | Clack | 33/566 |
| 2007/0209212 | A1 | 9/2007 | Vick et al. | |
| 2007/0254794 | A1 | 11/2007 | Johnson | |
| 2008/0022542 | A1 * | 1/2008 | Brosmith et al. | 33/562 |

* cited by examiner

PERSONAL SCORING TOOL

BACKGROUND

Scoring tools are used in a variety of settings to cut partway through a flat object creating a groove. The flat object can then be folded or broken along the groove creating two sections with clean edges.

Typically, a scoring tool has two parts: a guide and a scorer. To use the scoring tool, one would set up a guide along the line to be scored. The scorer would then be run along the guide to create the groove. Most scorers are blunt and as such do not cut all the way through the object.

Scoring tools are used in a variety of contexts and on a variety of products. For example, scoring tools are used to shape sheet metal, glass, quartz, marble and even chocolate. However, in the context of arts and crafts, the scoring tool has particular utility to create a variety of decorative and functional features in paper and cardboard. For example, scoring tools can be used to make decorative and functional features in paper crafting; gift wrapping; scrapbooking; card making; etc.

In such applications, a variety of scoring orientations and spacing is often desirable. However, conventional scoring techniques are not well-suited for such applications. For example, most conventional techniques are adapted to large scale scoring in industrial applications. Such techniques are too expensive and cumbersome to be of much value as a personal scoring device. Conventional techniques that are small enough to be useful as a personal scoring tool do not allow for precision in scoring orientation and spacing. They also are not well-suited for easy adaptability to a variety of circumstances.

The foregoing limitations in the current state of the art, as well as others as discussed below, are solved by the present invention in its various embodiments.

SUMMARY

The invention in its various embodiments includes the following features. It is a scoring tool comprising a base with a first edge and a second edge defining a recess; and one or more marker recesses. There is a pad capable of removably fitting into the defined recess and having one or more scoring guide lines. One or more markers having a locking mechanism capable of coupling with the marker recesses is included as is a pen assembly, capable of being removably coupled to the base and having one or more scoring tips. The scoring tool can include one or more marker guides on the first edge of the base, wherein the marker guide is a notch. The markers can include a protrusion capable of resting in the marker guide thereby securing the marker in place. The marker recess can be a hole in the base. The locking mechanism can be a retractable protrusion capable of coupling with the marker recesses. In one embodiment, the scoring tips are metal. In another embodiment, the scoring tips are metal carbide. The pen assembly can include a grip portion. The markers can include a gripping mechanism. The scoring tool can include a storage space. In one embodiment, the removable pad includes one or more protrusions capable of lining up with one or more corresponding recessions in the base. In yet other embodiments, the removable pad includes one or more recessions capable of lining up with one or more corresponding protrusions in the base. In yet other embodiments, the removable pad has a tacky side capable of releasably attaching to the base.

DETAILED DESCRIPTION OF THE ILLUSTRATED INVENTION

Figure 1:
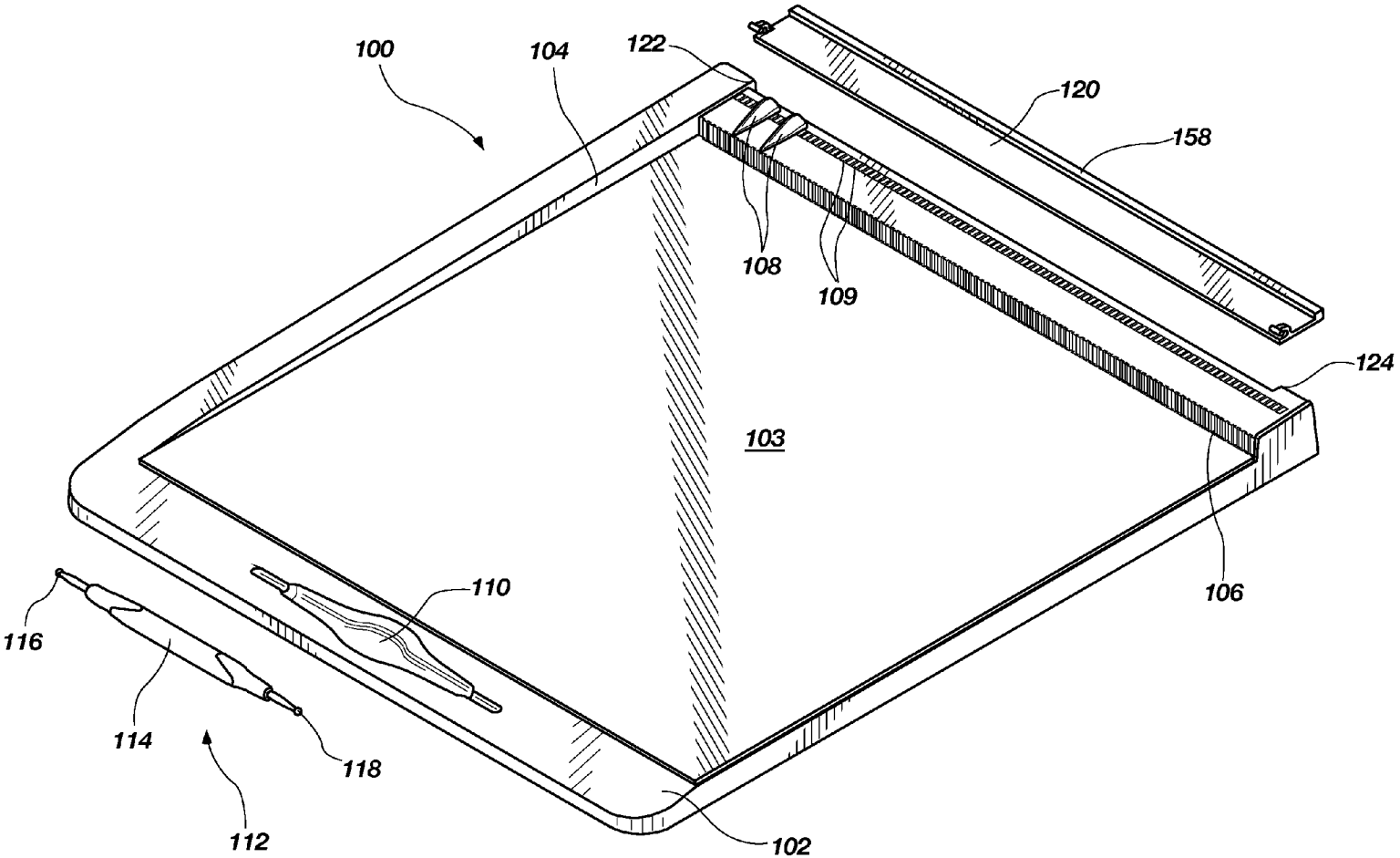
FIG. 1 shows a front elevational view of a personal scoring tool according to one embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring to FIG. 1, a front elevational view of a personal scoring tool 100 is shown according to one embodiment of the present invention. The scoring tool 100 includes a base 102 on which can be placed a removable pad insert 103. The base 102 has a side edge 104 and a top edge 106, defining a space into which the removable pad 103 can be inserted. It is noted that the terms "side" and "top" are provided only for illustrative purposes and are not intended to limit the scope of the claims to any particular orientation of the device. Edges 104, 106 serve to hold the pad 103 in place.

The base 102 can be furnished with one or more markers 108. As discussed further below, markers 108 can, in one embodiment, be secured in place through recesses 109 in combination with grooves 106 on the top edge 106. In the present embodiment, the recesses 109 are a series of substantially rectangular holes in the base 102 in which the marker 108 can be fastened. However, the recesses could have other shapes, depths and configurations that would accommodate a variety of marker fastening mechanisms.

The base 102 can also include a recess 110 into which a pen assembly 112 is inserted. The recess shown in this Figure is customized to the size of the pen assembly 112 such the pen assembly snaps into place and is held fast. In this embodiment, the pen assembly 112 includes a grip portion 114 and one or more scoring tips 116, 118. It is noted that in the present embodiment, the pen assembly 112 has two scoring tips 116, 118 of different size. It is noted that in some embodiments, it may be desirable to have only a single scoring tip. In this embodiment, the scoring tips 116, 118 are substantially rounded to avoid tearing the surface being scored. In other embodiments, the scoring tips could be more linear, as to create an edge for scoring; or could be tapered such that they come to more of a point.

The scoring tool 100 can also include a storage space for keeping additional styluses, tips, etc. In the present embodiment, the storage space is at the top end of the base 102 and includes a door 120 hingedly connected at corners 122 and 124.

In certain embodiments, it may be desirable to include one or more feet 126. In the present case, the feet 126 are circular, non-marking rubber pads secured to the base with an adhesive—which allow the scoring tool 100 to grip the surface on which it is placed. Numerous other materials as would be apparent to one skilled in the art could be utilized depending on the environment in which the tool 100 is to be used.

Figure 2:
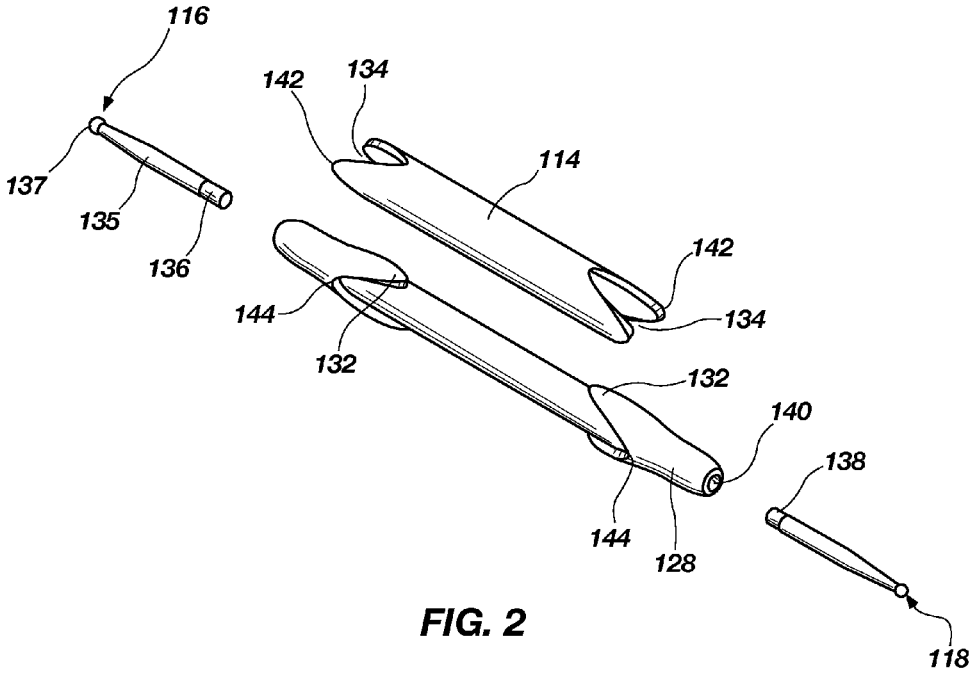
FIG. 2 shows a disassembled pen assembly for use in connection with the personal scoring tool according to one embodiment of the present invention.
Figure 3:
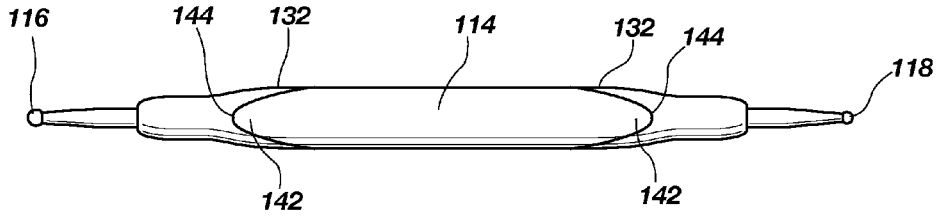
FIG. 3 shows an assembled pen assembly for use in connection with the personal scoring tool according to one embodiment of the present invention.

Referring now to FIGS. 2 and 3, the pen assembly 112 can include a body 128 having female ends 140 corresponding to male ends 136, 138 on the scoring tips 116, 118. In the present embodiment, the male ends 136, 138 are attached to the body 128 by heat stake or ultrasonic welding. Numerous other attachment mechanisms would be apparent to one skilled in the art and are considered within the scope of the present invention.

The body 128 is, in one embodiment, made of ABS material. However, it can be made of numerous other materials including, but not limited to, other plastics, wood and metal. The body can include a comfort grip portion 114. In the present embodiment, the grip portion 114 is an overmold made of thermoplastic elastomers. However, it can made of numerous other materials including, but not limited to, other types of rubber, plastic, metal, cloth or wood. The grip 114 in this embodiment has protrusions 142 and recessions 134 that correspond to protrusions 132 and recessions 144 in the body 128. The grip 114 can include ergonomically friendly features and configurations.

The scoring tips 116, 118 can be a variety of shapes. For example, tip 116 is substantially cylindrical at its base and tapers at 135 to a ball point 137—which as noted above, can be various sizes and need not be spherical. In the present embodiment, the scoring tips 116, 118 are made of metal. It has been discovered that metals and metal carbides work exceptionally well for scoring applications.

Referring now to FIGS. 4-9, the markers 108 allow the user to keep track of the lines being scored with great precision and accuracy. In one embodiment, the marker 108 is a plastic piece having a gripping mechanism 146. The gripping mechanism 146 allows the user to easily place and remove the marker 108 as needed. The marker 108 can also include a locking mechanism 148. In the present embodiment, the locking mechanism 148 includes a retractable bump protrusion 150 that allows the marker 108 to securely snap into recesses 109.

Figure 4:
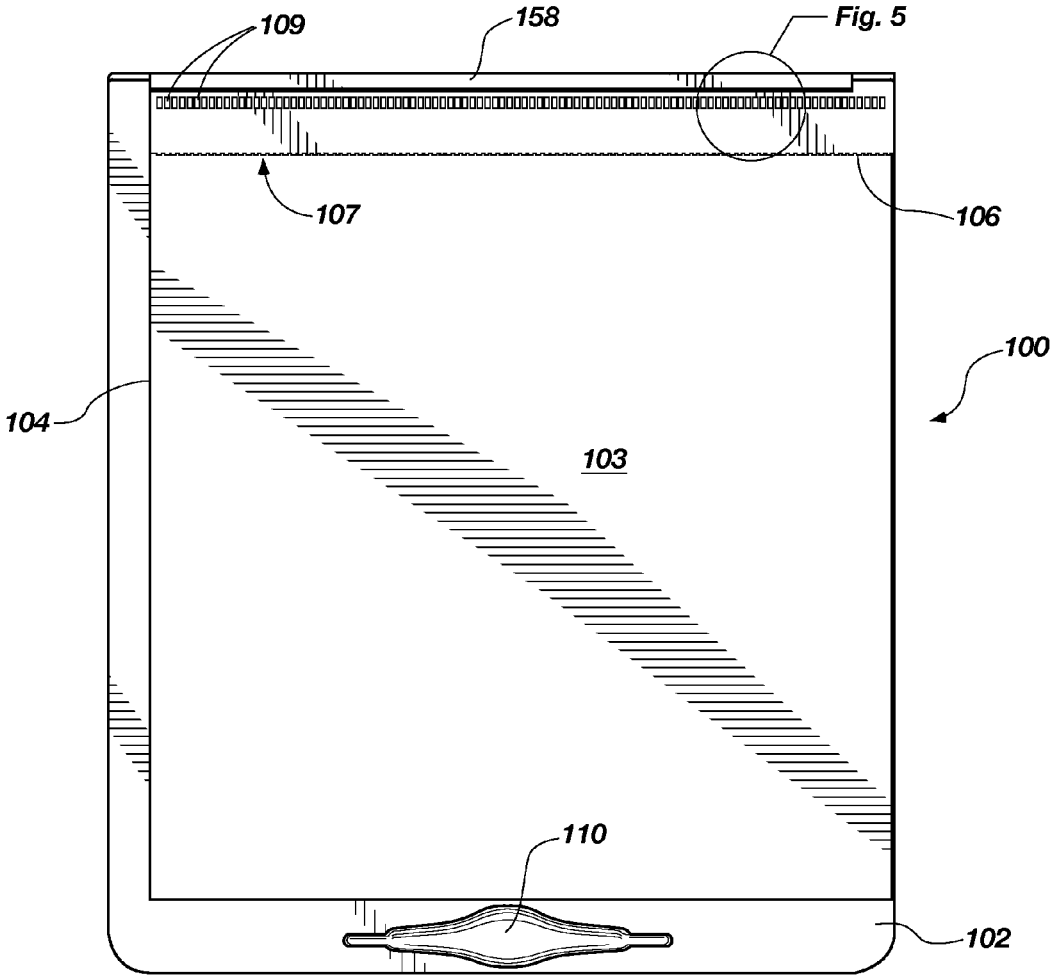
FIG. 4 shows a top view of a personal scoring tool according to one embodiment of the present invention.
Figure 5:
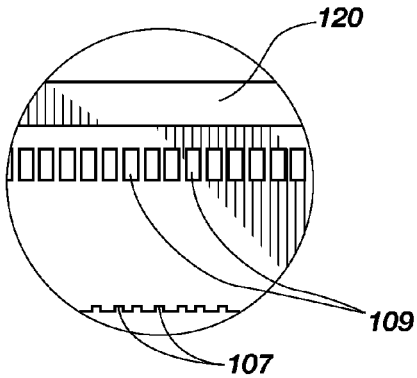
FIG. 5 shows an exploded view of the marker guide device according to one embodiment of the present invention.
Figure 6:
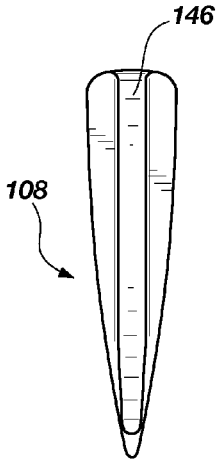
FIG. 6 shows a top view of a marker according to one embodiment of the present invention.
Figure 7:
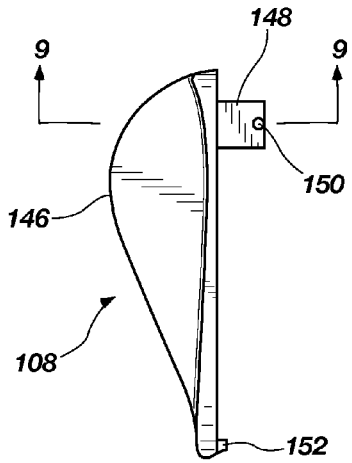
FIG. 7 shows a side view of a marker according to one embodiment of the present invention.
Figure 8:
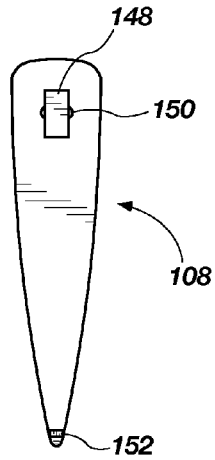
FIG. 8 shows a bottom view of a marker according to one embodiment of the present invention.
Figure 9:
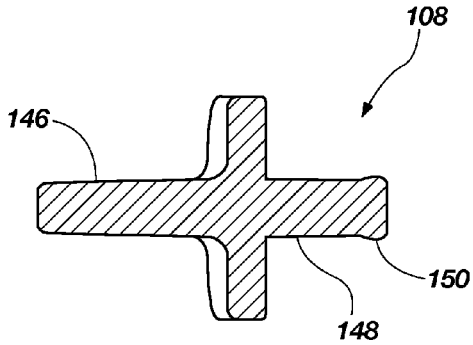
FIG. 9 shows a cross-sectional view of the marker in FIG. 7 according to one embodiment of the present invention.
Figure 10:
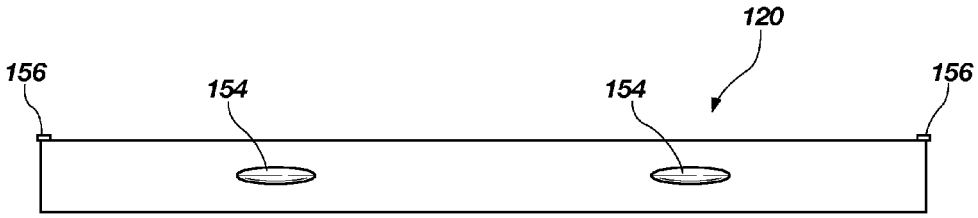
FIG. 10 shows a front inverted view of a storage compartment door according to one embodiment of the present invention. (however door could be hinged on top or bottom or really either or both sides)
Figure 11:
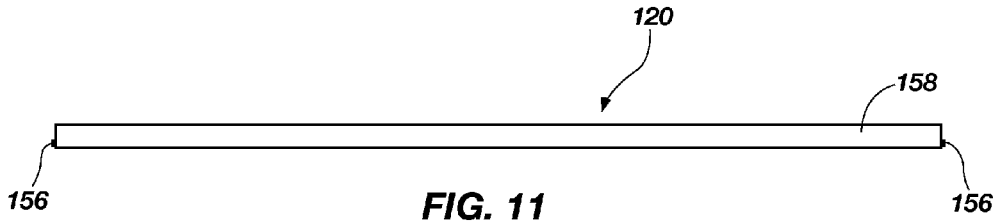
FIG. 11 shows a top view of a storage compartment door according to one embodiment of the present invention.
Figure 12:
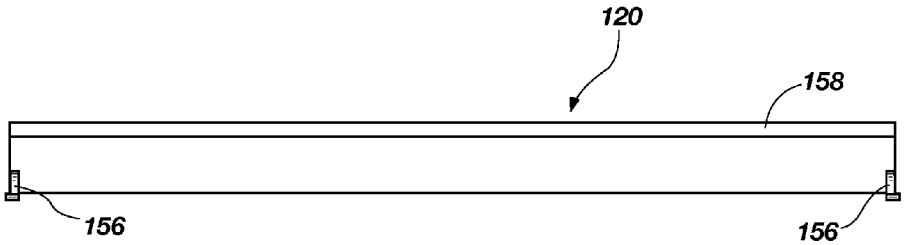
FIG. 12 shows a rear view of a storage compartment door according to one embodiment of the present invention.
Figure 13:
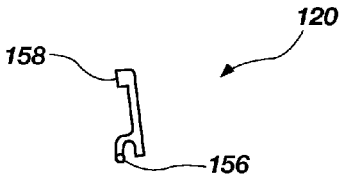
FIG. 13 shows a side view of a storage compartment door according to one embodiment of the present invention. (shows more detail of hinging mechanism, but numerous other hinging mechanisms would be apparent to one skilled in art).
Figure 14:
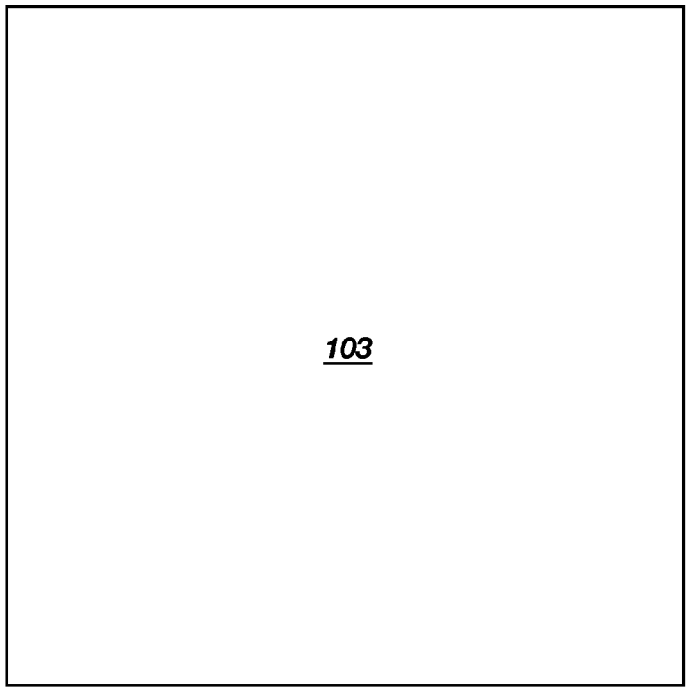
FIG. 14 shows a top view of a removable pad insert according to one embodiment of the present invention.

The embodiment shown in FIG. 4, also includes marker guides 107 in the top edge 106 of the base 102. These marker guides 107 are notches or grooves that correspond to protrusions 152 on the marker 108, thus allowing the marker 108 to be secured in two places—namely the locking mechanism 148 securing the marker 108 in recesses 109 and the protrusion 152 securing the marker 108 in guides 107.

It is noted that in certain embodiments, it may be desirable to include only one of the foregoing features, depending on the desired mobility of the marker 108.

The markers in the present embodiment are made of plastic. However, it is noted that they could be made of a variety of materials including, but not limited to, metal, wood, and hard rubber.

Referring now to FIGS. 10-13, a storage space door 120 is shown according to one embodiment of the present invention. The door 120 includes handles 154 and a hinging mechanism 156 that attaches at corners 122 and 124. As best seen in FIG. 4, the base 102 can include a recess that allows the top edge of the door 158 to be substantially flush with the base.

Figure 15:
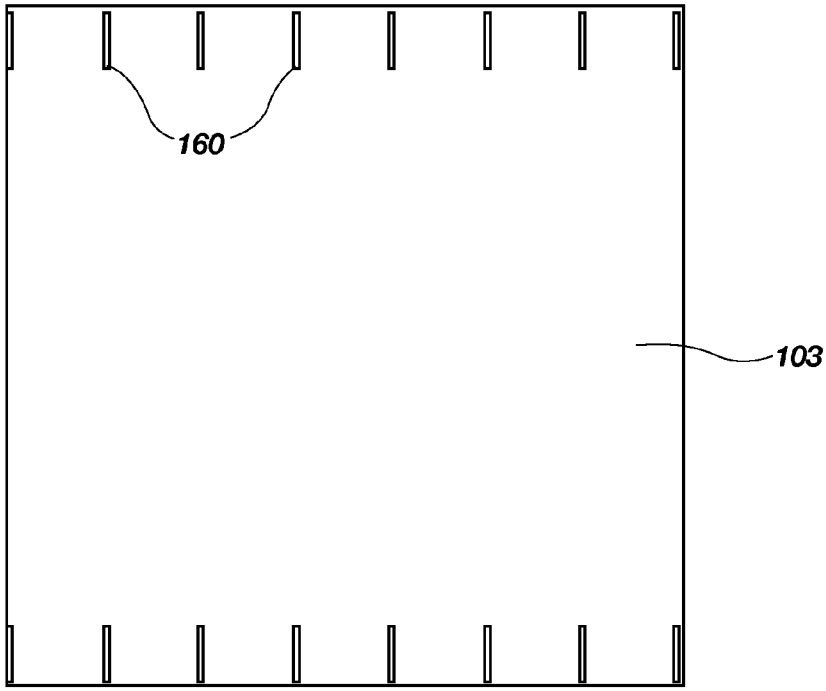
FIG. 15 shows the underside of a removable pad insert according to one embodiment of the present invention.
Figure 16:
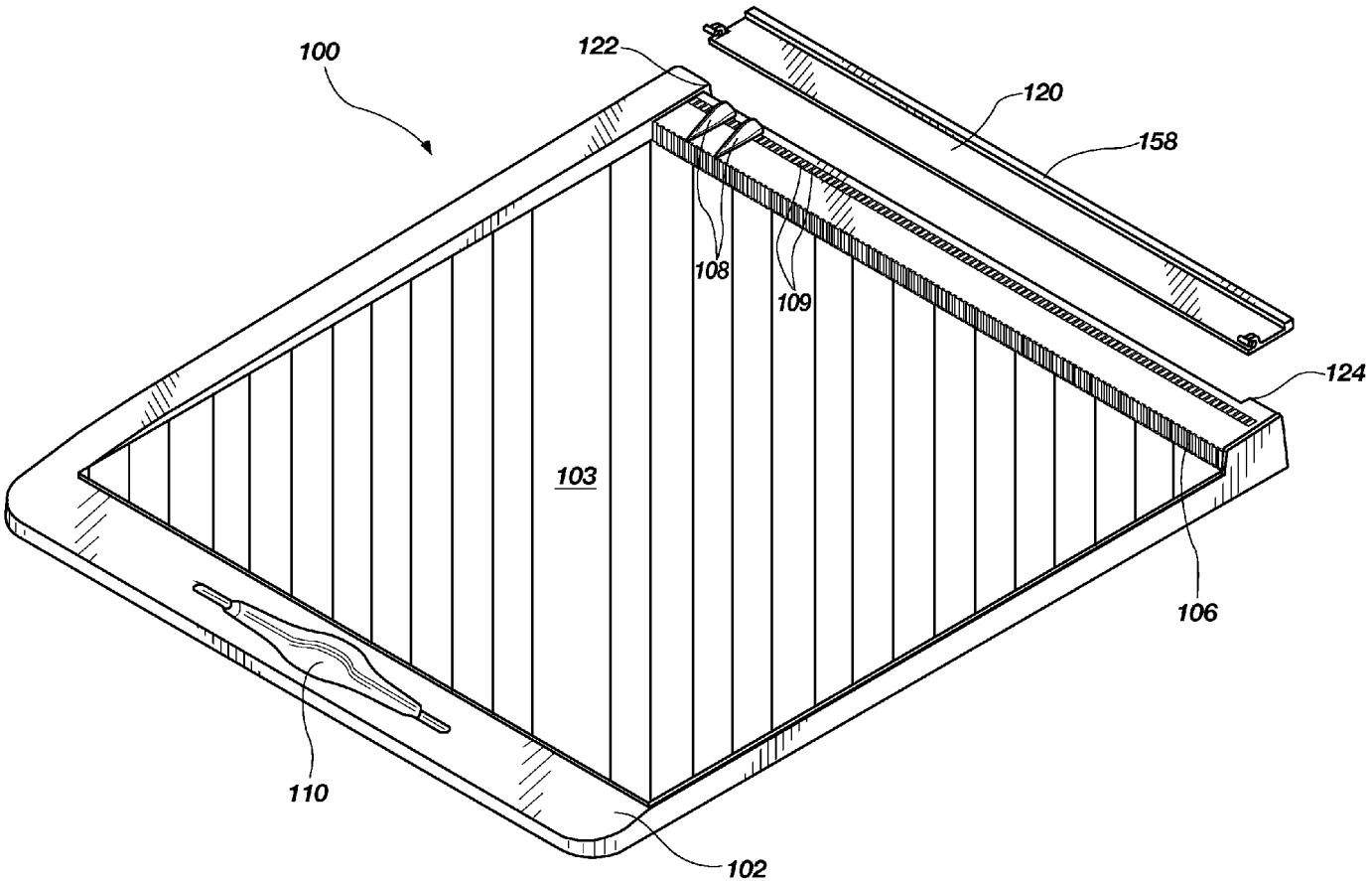
FIG. 16 shows a personal scoring tool according to one embodiment of the present invention.
Figure 17:
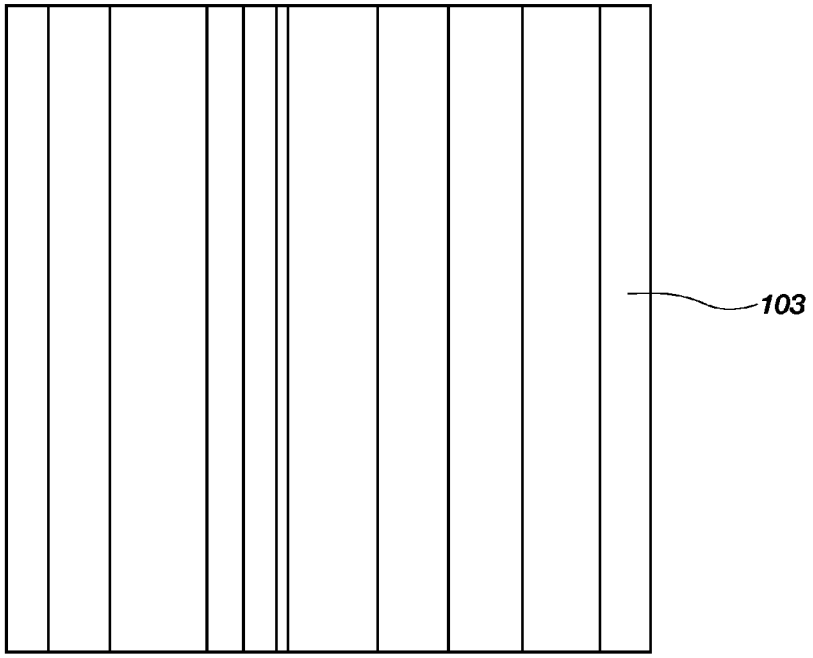
FIG. 17 shows a removable pad insert having different scoring guide line orientations according to one embodiment of the present invention.

Referring to FIGS. 14-17, the removable guide pads 103 can include all manner of scoring guide line orientations and can be swapped out according to the user's preferences and needs. As seen in FIGS. 16 and 17, the scoring guide lines on the guide pad 103 can be angular, vertical, horizontal, or even combinations thereof in their orientation. They can be uniformly spaced or not. The guide lines can be tightly grouped or comparatively far apart. The removable guide pads 103 allow for great diversity in scoring capabilities for comparatively low cost. It also allows a user to easily and relatively inexpensively replace worn out or otherwise unusable pads.

Referring to FIG. 15, the bottom of the guide pad 103 can include 160 ridges or other protrusions that line up with corresponding grooves or recessions in the score pad base 102 to secure the pad 103 to base 102. It is noted that the securing of the pad 103 in this manner could also be done in numerous other ways including, but not limited to, having the protrusions be on the base 102 and the recessions on the pad 103. The security of the pad 103 could also be accomplished by including a tacky surface on the underside.

The pad could be made of a variety of materials including, but not limited to, plastic, rubber, metal, cloth or wood.

It is understood that the above-described arrangements are only illustrative of the application of the basic principles of the present invention. Numerous modifications and alternative arrangements may be devised by those skilled in the art without departing from the spirit and scope of the present invention. The appended claims are intended to cover such modifications and arrangements.

What is claimed is:

1. A scoring tool comprising:

a) a base having
a first edge and a second edge defining a recess; and
one or more marker recesses;

b) a pad capable of removably fitting into the defined recess and having one or more scoring guide lines; and c) one or more score tracking markers having a locking mechanism capable of coupling with the marker recesses, wherein the locking mechanism is a retractable protrusion capable of coupling with the marker recesses;

d) a pen assembly, capable of being removably coupled to the base and having one or more scoring tips.

2. The scoring tool of claim 1 further comprising one or more marker guides on the first edge of the base, wherein the marker guide is a notch.

3. The scoring tool of claim 2, wherein the score tracking markers include a protrusion capable of resting in the marker guide thereby securing the marker in place.

4. The scoring tool of claim 1, wherein the marker recess is a hole in the base.

5. The scoring tool of claim 1, wherein the scoring tips are metal.

6. The scoring tool of claim 1, wherein the scoring tips are metal carbide.

7. The scoring tool of claim 1, wherein the pen assembly includes a grip portion.

8. The scoring tool of claim 1, wherein the score tracking markers further include a gripping mechanism.

9. The scoring tool of claim 1, further including a storage space.

10. The scoring tool of claim 1, wherein the removable pad includes one or more protrusions capable of lining up with one or more corresponding recessions in the base.

11. The scoring tool of claim 1, wherein the removable pad includes one or more recessions capable of lining up with one or more corresponding protrusions in the base.

12. The scoring tool of claim 1, wherein the removable pad has a tacky side capable of releasably attaching to the base.

* * * * *